US005755060A

United States Patent [19]

Zweili

[11] Patent Number: 5,755,060

[45] Date of Patent: May 26, 1998

[54] COMPACT PANEL LOCK FOR AN OVERHEAD MOUNTED DOOR PANEL OPERATOR

[75] Inventor: Marc Zweili, Roxboro, Canada

[73] Assignee: Vapor Canada, Inc., Quebec, Canada

[21] Appl. No.: 659,779

[22] Filed: Jun. 6, 1996

Related U.S. Application Data

[60] Provisional application No. 60/000,094 Jun. 9, 1995.

[51] Int. Cl.[6] ..... E05B 55/00

[52] U.S. Cl. ..... 49/449; 49/322; 49/86.1; 49/90.1

[58] Field of Search ..... 49/449, 86.1, 104, 49/90.1, 123, 118, 322, 503, 370; 292/341.17, 153, DIG. 46

[56] References Cited

U.S. PATENT DOCUMENTS

| | | | |
|---|---|---|---|
| 4,062,209 | 12/1977 | Downing et al. | 292/341.17 |
| 4,674,231 | 6/1987 | Radek et al. | 49/118 |
| 4,783,102 | 11/1988 | Bernard | 292/341.17 |
| 5,148,631 | 9/1992 | Bayard et al. | 49/449 |
| 5,247,763 | 9/1993 | Hein | 49/123 |

*Primary Examiner*—Blair Johnson
*Assistant Examiner*—Curtis Cohen
*Attorney, Agent, or Firm*—Francis J. Lidd

[57] ABSTRACT

A compact mechanical lock for bi-parting handles of passenger doors used on mass transit vehicles. Rotating lock cams cooperating with an interlocking lock plate to ensure proper closure of each panel prior to lock actuation.

4 Claims, 5 Drawing Sheets

COMPACT PANEL LOCK FOR AN OVERHEAD MOUNTED DOOR PANEL OPERATOR

This application claims the benefit of U.S. Provisional application Ser. No. 60/000,094, filed Jun. 9, 1995.

BACKGROUND OF THE INVENTION

This invention relates generally to automatic power operated drive systems for mass transit rail vehicles. Specifically, this invention pertains to an overhead power actuator utilizing a belt drive to open and close bi-parting door panels over an opening in the side wall of a mass transit rail car vehicle. More specifically, the power operator of the invention disclosed herein utilizes both electrical and pneumatic prime movers for opening and closing the above-mentioned door panels.

Belt driven bi-parting door panels are disclosed in U.S. Pat. No. 5,148,631. The specification of U.S. Pat. No. 5,148,631 is hereby incorporated by reference hereto.

Generally speaking, belt driven door panels can be and are locked through belt locking systems, sometimes termed a "secondary or operating lock." However, as those skilled in the art will readily understand, any failure of the belt would result in a free-wheeling door. In order to overcome the problems of a belt locked system, the '631 patent incorporates a primary or mechanical lock essentially paralleling the secondary or belt lock. However, the primary lock disclosed in the '631 patent has many shortcomings among which are a relatively complex and less reliable method of interlocking panel closing or ensuring that the door panels are closed prior to actuation of the prime mover. An additional difficulty arises from the overhead space consumed by the structure involved. A further difficulty arises from the isolation of lock actuation from door panel movement. In particular, the lock of the invention disclosed herein overcomes these difficulties through actuation of the lock by the closing panels and requiring that each panel be in a closed and locked position before a lock signal is provided.

Therefore, it is the object of the invention to provide a positive mechanical door panel lock for sliding bi-parting vehicular door, wherein panels driven into the closed and locked position actuate the lock, and the shifting lock bar requires that each panel must be engaged prior to the consequence of the locking action.

It is an additional object of this invention to provide a positive mechanical lock for sliding bi-parting doors wherein a single lock member articulates the lock function of both panels, interlocks the door operator prime mover, and provides emergency release.

It is yet an additional object of the invention to provide a compact, self-articulating, self-interlocking panel lock and emergency release economically and employing a minimum number of moving parts, thereby providing high reliability.

SUMMARY OF THE INVENTION

The invention disclosed herein provides, a direct panel lock for a belt actuated overhead mounted door operator adaptable to either pneumatic or electric prime movers utilized to drive the operating belt. Pneumatic prime movers may employ a double acting cylinder or the rodless type utilized in U.S. Pat. No. 5,148,631.

Door movement is achieved through motion of a continuous toothed belt journaled at either ends of the operator base plate mounted overhead of the car door opening (reference U.S. Pat. No. 5,148,631). Attached to oppositely moving portions of the drive belt are adjacent door panel brackets providing reciprocating panel movement for unitary belt motion.

A low friction door support member is affixed to an operator base plate so as to provide clearance for the reciprocating door brackets. Intermediate the belt drive pulleys is a door lock assembly utilizing distally positioned lock cams on a lock member base plate. The lock cams are journaled on the lock base plate for rotary motion in the door panel plane. The lock cams incorporate peripherally adjacent slots sequenced for individual door panel actuation, and lock pawl containment. Also attached to the door lock base is a longitudinally disposed lock plate having lock pawls at either end, an interlock switch operating cam intermediate said lock pawls. A transversely projecting door unlock stud or lever extends from said lock bar, adjacent the interlock cam.

Articulated actuation of the lock is obtained through engagement of a lock pin extending from each door panel with the appropriate door lock cam slot on movement of the door panel toward a closed position. When each door is in the fully closed position, door lock cams have rotated so as to allow cooperation between the door lock pawls on the door lock plate thereby preventing further motion of the doors. Movement of the door lock plate attendant to the lock pawl and cam slot engagement further causes the switch actuating cam on said door lock plate to actuate an interlock switch, resulting in removing power from the belt drive prime mover.

Reverse or opening panel operation is accomplished by laterally shifting the door lock plate either by a forward lock actuator, or manually by applying lateral force to the unlock stud, thereby disengaging the lock plate pawls from their position in the door lock cam. The power lock actuator can be a pneumatic cylinder, electromagnetic solenoid (Reference FIGS. 4 and 5) or other equivalent thereof. Lock plate movement to an open position further shifts the interlock switch cam so as to enable power input to the belt prime mover.

While the invention disclosed herein will be described in connection with a preferred and alternate embodiments utilizing pneumatic and electric prime movers, respectively, it will be understood that these embodiments do not limit the invention to those specific embodiments. On the contrary, applicant intends to cover all alternatives, modifications and equivalents as may be included within the spirit and scope of the invention as defined by the appended claims.

DETAILED DESCRIPTION OF THE INVENTION

Figure 1:
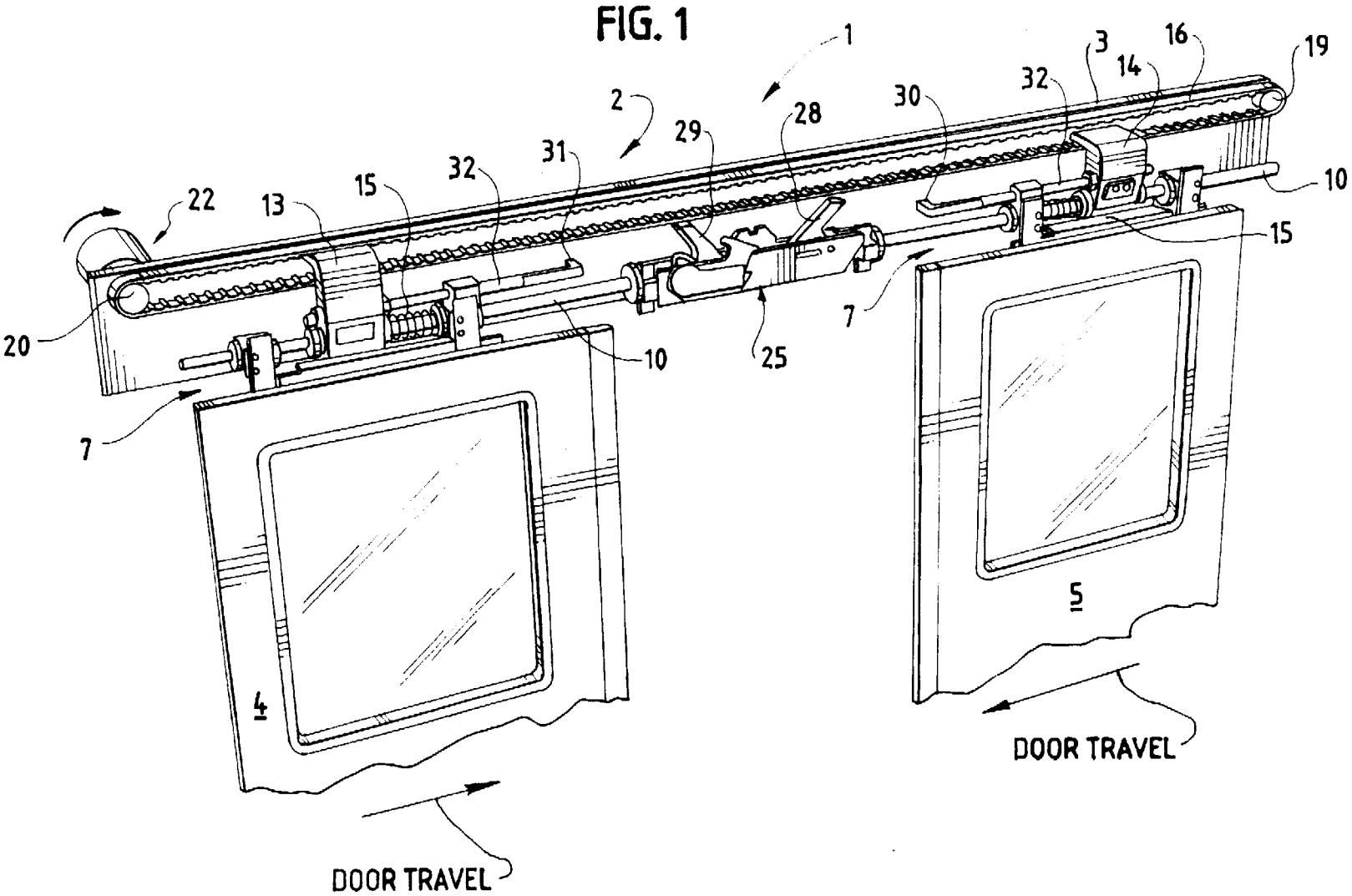
FIG. 1 is a partial perspective of the operator of the invention, particularly showing the reciprocating panels in a partially open position and an electric motor drive of the operating belt.
Figure 1A:
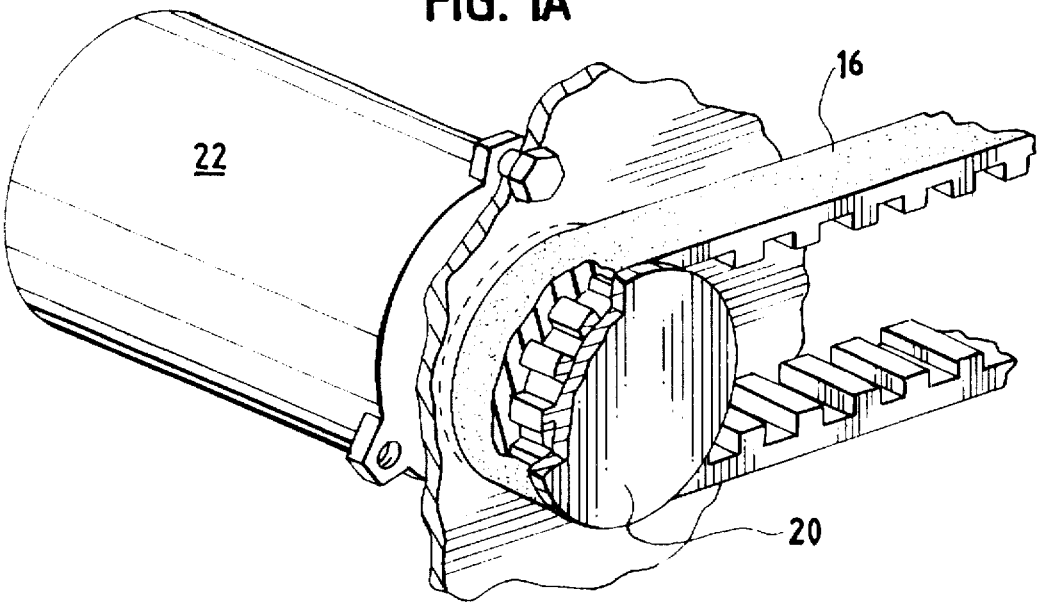
FIG. 1A is a partial tearaway view of FIG. 1, particularly showing the electric prime mover and belt drive, a partial perspective of an alternate construction of the invention disclosed, particularly showing the pneumatic cylinder prime mover coupled to the belt drive, and a C-channel type door support. Also shown without the door panels in place is an upper door hanger having projecting door panel lock pins.

In particular reference to FIG. 1, there is shown a complete bi-parting door system as mounted in a mass transit vehicle for opening and closing a door opening in the side wall of the transit vehicle.

The lock system 1 includes bi-parting panels 4 and 5 mounted for reciprocal motion when driven by an overhead door operator assembly 2. The operator assembly 2 includes an operator base plate 3, a drive belt 16 journaled at either ends of the base plate, a rotating idler pulley 19 and belt drive pulley 20, driven by an electric drive prime mover or electric motor 22. The belt 16 is of the well known toothed or timing gear type having bars and grooves cooperating with similar bars and grooves contained on the drive pulley 20 providing positive motion between the drive pulley 20 rotation and travel of the belt 16. Attached to opposing sides of the belt 16 are the left hand door drive member 13 and the right hand door drive member 14. Also attached to the base plate 3 is a door hanger 10 cooperating with a panel hanger assembly 7 to provide low friction door support during movement of the panels 4 from opened to closed as the assembly 7 traverses, open to closed, over an opening the car side wall.

An integral portion of the hanger assembly 7 is a push back assembly 15 (not described) providing limited movement of the door panel along the hanger 10, particularly when the door is in a full closed position. The advantages of the push back feature are associated with passenger-door interface. As this is not a part of the invention disclosed herein, this feature will not be further discussed.

Also as part of the panel hanger assembly 7 are panel hanger lock pins 30 and 31 projecting inwardly from the door opening from lock pin carrier 32 on right hand panel drive members 14 and 15, respectively. The function of these lock pins will be discussed in more detail below.

Longitudinally disposed along the door hanger 10 is the panel lock assembly 25, a primary feature of the invention disclosed herein. The lock assembly 25 includes a projecting portion of lock cams 28 and 29 cooperating with lock pins 30 and 31, respectively, in providing locking action during door closed motion.

In operation, the operating system disclosed herein beginning with the condition shown in FIG. 1 wherein the bi-parting doors are partially opened and traveling in a closed direction, movement is initiated by clockwise rotation of the drive pulley 22 as shown. Clockwise motion of drive pulley 20 driven by prime mover 22 results in belt motion wherein panel drive members 13 and 14 move in the direction indicated as door travel, i.e., toward a closed position.

Figure 6:
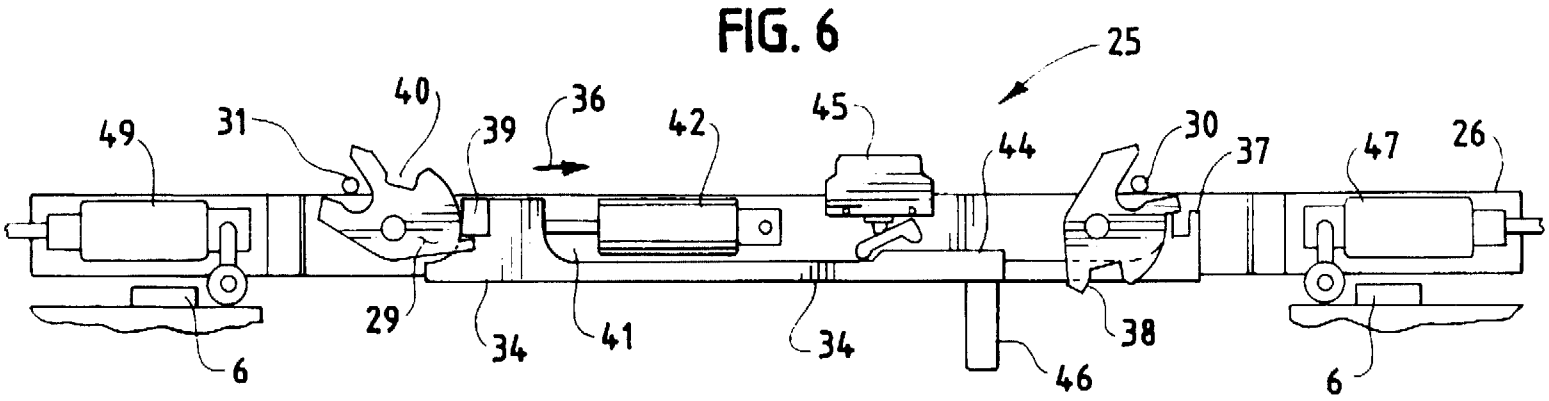
FIG. 6 is a partial front view of the lock of the invention in a door open and unlocked condition, particularly showing positions of the door lock cams, the prime mover interlock switch and cam, and adjacent door panel sensing switches shown disengaged from cams carried at the upper leading edge of each door panel.
Figure 7:
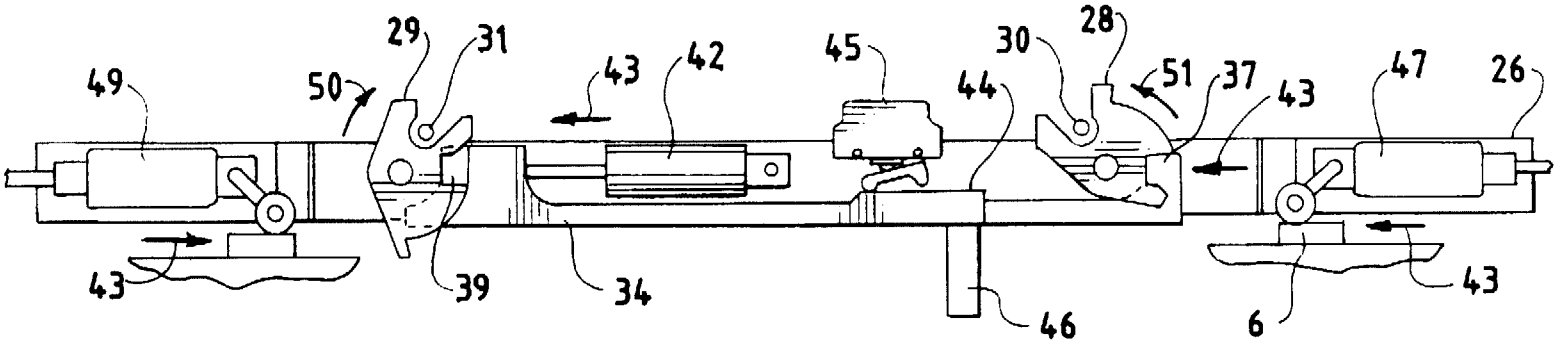
FIG. 7 is an additional partial front view of the lock of the invention, a door closed and locked position. Particularly shown are the positions of the door lock cams engaging lock pawls of the sliding lock plate. Also shown is the door interlock switch as actuated by a cam on the lock plate. Adjacent door panel detection switches are also shown in an actuated or door closed position.

Operation of the door lock assembly 25 with door movement in the closing direction and prior to the panels reaching a full closed position is shown in FIG. 6. With further reference to FIGS. 6 and 7, operation of the panel lock of the invention disclosed herein will be described as follows:

As shown in FIG. 6, panel lock cams 28 (right hand) and 29 (left hand) are journaled for rotary motion on the lock base plate 26 are shown in an unlocked position. All positions of the lock assembly 25 are positioned immediately prior to the locking position which is shown in FIG. 7. Returning to FIG. 6, the lock plate 34 is shifted in the door opening position as shown by motion arrow 36. This motion is achieved through actuation in the direction shown of a door unlock drive member 42 acting through rod 41. Also shown in the door unlock position is the de-energized condition of interlock switch 45 since the panel lock plate switch cam 44 has shifted in the right hand direction.

Also, the panel hanger lock pins 30 and 31 are shown in a position immediately prior to contacting cooperating slots in lock cams 28 and 29. In this position, door panels 4 and 5 (reference FIG. 1) panel sensing switch cams 6 arranged to cooperate with panel sensing switches 47 and 49 have not actuated switches 47 and 49. Therefore panel switch cams 6 have not actuated panel sensing switches 47 and 49 and, a door closed position is not indicated by either switches 47 or 49 (reference FIG. 6). Also, since lock plate lock pawls 37 and 39 have not engaged the cooperating lock slots 38 and 40 switch 45 is not actuated by lock plate switch cam 44 (reference FIG. 6).

On door motion to a fully closed and locked position (reference FIG. 7) motion of the door panel lock pin carriers 32 have moved door lock pins 30 and 31 into contact with cams 28 and 29. Further, motion into a fully closed and locked position rotates cams 28 and 29 into position shown in FIG. 7 whereupon the door panel lock plate 34 is shifted in the direction of arrow 43 by a spring loaded actuator rod 41. The lateral shift in the direction shown ensures that when cams 28 and 29 are rotated in a direction shown by arrows 50 and 51, lock pawls 37 and 39 are positively in place in slots 38 and 40 as shown (reference FIG. 7). In this position of the lock plate 34 interlock switch cam 44 has actuated switch 45, thereby interrupting power to the door operator prime mover and further establishing circuitry which requires that door unlock drive member 42 be energized thereby shifting lock plate 34 to an open position (reference FIG. 6) prior to energizing a prime mover where movement from door closed to door open, thereby ensuring that the doors remain locked and that the opening sequence is established.

In an opening operation, as described above, lock actuator 42 would be energized by a controller operating suitably from signals supplied by switch 45, thereby shifting lock plate 34 in the direction which would remove lock plate pawls 37 and 39 from slots 38 and 40. The shift of lock plate 34 would further de-energize switch 45 through operation of switch cam 44, thereby allowing power to be applied to a prime mover which would then move door panels 4 and 5, now unlocked, to an opened position.

Figure 4:
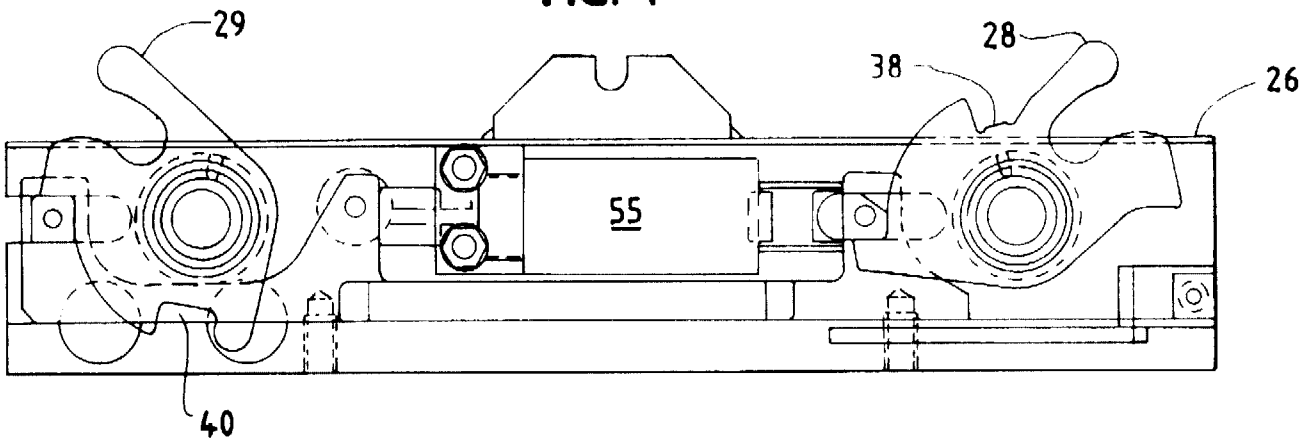
FIG. 4 is a front view of an alternate lock of the invention showing location of an electro-mechanical solenoid, and associated lock plate cams in an unlocked condition.
Figure 5:
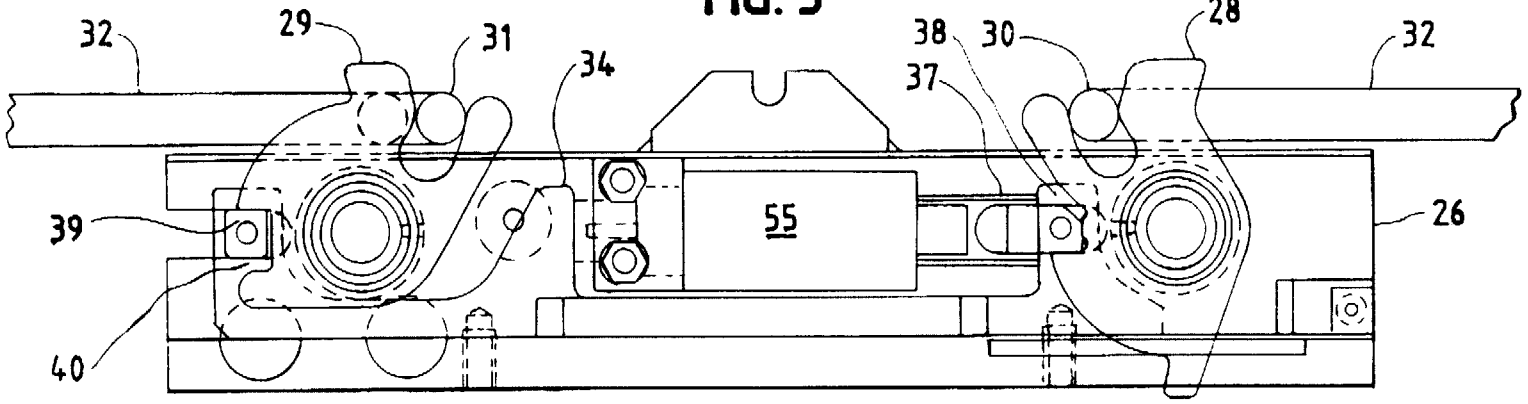
FIG. 5 is an additional front view of the alternate form of the invention of FIG. 4 with the electro-mechanical actuator, door lock cams, and lock plate in a door closed position. Also shown are door panel actuating rods engaging the lock pawls in the door closed and locked position.
Figure 5A:
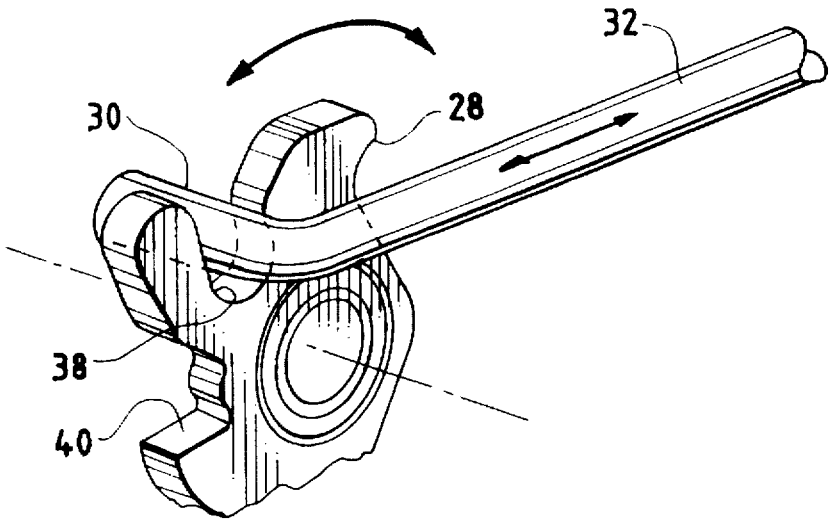
FIG. 5A is a partial tearaway view of FIG. 5, particularly showing lock pin carrier and lock pin engaging the lock cam.

In an alternate embodiment shown in FIGS. 4 and 5, the lock plate 34 is actuated by an electro-mechanical solenoid 55, thereby achieving locking and unlocking action aided by actuator 42 described herein.

Figure 2:
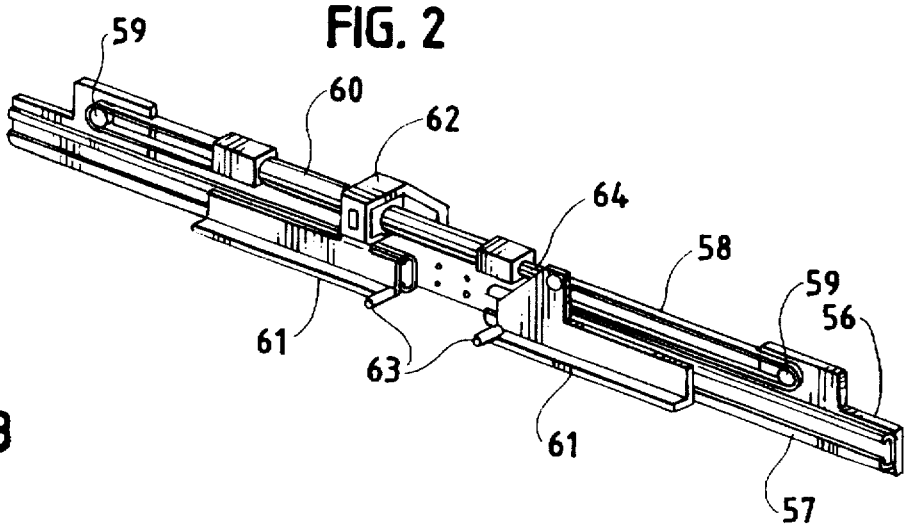
Figure 3:
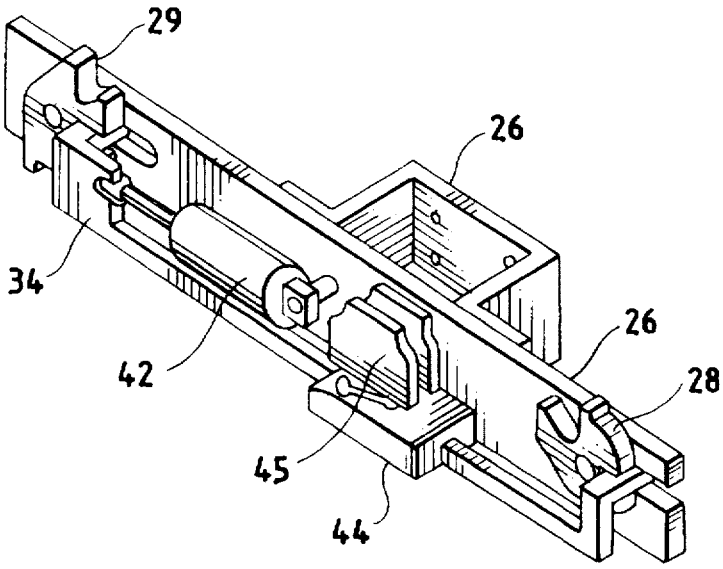
FIG. 3 is a perspective view of the operating members of the door lock of the invention, particularly showing a lock plate, lock pawls, switch interlock cam, and unlocking actuator mounted on a back plate.

The alternate embodiment shown in FIG. 2 utilizes a pneumatic cylinder 60 as a prime mover for the drive belt 58. For the sake of clarity, only the fundamental drive system is shown in FIG. 2 in order to demonstrate the differences between pneumatic and electric prime mover drives for the system disclosed herein.

As shown in FIG. 2, the drive system is mounted on a base plate 56. Mounted on extensions of the base plate 56 are idler pulleys 59 cooperating with the drive belt 58 to provide opposite motion of door hangers 61. Also mounted on the base plate 56 is a low friction door slide 57. In this case, of the type having internally contained low friction rollers. Attached to a movable member of the door slide are door hangers 61. Extending from the door hangers 61 are door lock pins 63.

Drive force applied to the belt 58 is supplied by pneumatic cylinder 60 attached to the member 62, with the cylinder extension rod 64 attached to base plate 56.

As in the preferred embodiment described above, door drive members 61 are attached to oppositely moving portions of drive belt 58, providing reciprocal movement of door drive members 61. Therefore, this arrangement provides equivalent bi-parting door motion of the electric drive of the preferred embodiment as described above. Door lock pins 63 cooperate with lock cams 28 and 29 in order to provide the door locking function also as described above.

It is apparent that there has been provided in accordance with the invention disclosed a positive door panel lock for bi-parting doors in a mass transit vehicle fully satisfies the objects, aims and advantages as set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as may fall within the spirit and broad scope of the appended claims.

What is claimed as new and desired to be secured by letters patent of the united states is:

1. In combination, a mechanical lock and power operated bi-parting passenger doors in a mass transit vehicle and, a pair of door panels mounted for reciprocal motion opening and closing a passenger entrance in the side wall of said mass transit vehicle, said panels having an upper, horizontal edge and vertical abutting edges for a door closed position comprising:

means mounting said door panels overhead said passenger opening;

a lock actuating member on each panel, said member mounted along said upper door edge and extending over said abutting vertical door edges when said doors are in a closed position;

lock actuating pins on said lock actuating member, said pins located adjacent to and extending inwardly of said abutting panel edges;

a door operator on a base plate, said base plate mounted overhead said doors for driving said door mounting means; and, a lock assembly on said base plate and centered over said abutting door edges comprising:

a lock base plate;

lock cams on said lock base plate, said cams disposed adjacent said lock actuating pins, and journaled for rotary motion in a plane parallel to said lock base plate;

a lock plate having lock pawls extending from distal ends, said lock plate slidably mounted on said lock base plate for lateral motion there along;

first slot on each said lock cam periphery, said slots co-acting with adjacent lock pawls in a door closed position;

a projection and adjacent second cam slot on each said lock cam periphery, said projection and second cam slot co-acting with said lock pins for rotating said cams during door motion from open to closed, said second slot rotatably disposed from said first slot for said door motion from open to closed;

force biasing means for maintaining said lock pawls in abutment with said lock cams;

wherein said door motion from a door open position to a door closed position moves said actuating: pins into contact with said cam projection and second cam slot, thereby rotating said cams to a door closed position wherein said lock pawls enter said first cam slot, thereby preventing cam rotation and door panel motion from said closed position.

2. A direct panel lock and power operated bi-parting door panels, said panels opening and closing a passenger opening in the side wall of a mass transit vehicle comprising:

means driving said doors from opened to closed over said opening;

a lock baseplate mounted overhead said panels, said baseplate centered on said panels for a door closed position;

lock cams journaled on said baseplate for rotary motion in a plane parallel to said lock baseplate, said cams having unlocked and locked positions;

a force biased lock bar on said baseplate;

lock slots on said lock cams;

actuating means on said panels, said actuating means for engaging said lock cams, said engagement moving said cams from an unlocked to a locked position on movement of said panels by said door drive means from opened to closed position;

wherein said force biased lock bar engages said lock slots retaining said cam in a door closed condition, thereby locking said door panels in a closed position.

3. The direct panel lock for claim 2 wherein said lock cams include actuating slots adjacent said lock slots for engagement by said panel actuating means and holding means, respectively.

4. The direct panel lock of claim 3 wherein said panel actuating means includes a lock pin carrier and lock pin mounted on said door panel and projecting inwardly and in the direction of door panel closing.

* * * * *